US005237953A

United States Patent [19]

Mannerfelt

[11] Patent Number: 5,237,953

[45] Date of Patent: Aug. 24, 1993

[54] ACCESSORY RAIL FOR BOATS

[76] Inventor: Göran Mannerfelt, Trebackavägen 12, S-182, 65 Djursholm, Sweden

[21] Appl. No.: 852,211

[22] PCT Filed: Nov. 23, 1990

[86] PCT No.: PCT/SE90/00774

§ 371 Date: May 29, 1992

§ 102(e) Date: May 29, 1992

[87] PCT Pub. No.: WO91/08138

PCT Pub. Date: Jun. 13, 1991

[30] Foreign Application Priority Data

Nov. 29, 1989 [SE] Sweden ..... 8904039

[51] Int. Cl.[5] ..... B63B 1/32

[52] U.S. Cl. ..... 114/343; 114/56; 114/288

[58] Field of Search ..... 114/271, 290, 291, 358, 114/56, 288, 355, 343

[56] References Cited

U.S. PATENT DOCUMENTS

| | | | |
|---|---|---|---|
| 2,677,139 | 4/1954 | Canazzi | 114/358 |
| 2,919,669 | 1/1960 | Kikuhara | 114/291 X |
| 3,137,261 | 6/1964 | Noe | 114/66.5 |
| 3,226,739 | 1/1966 | Noe | 114/56 |
| 3,361,104 | 1/1968 | Glass | 114/290 |
| 4,159,691 | 7/1979 | Paxton | 114/290 |

*Primary Examiner*—Sherman Basinger
*Attorney, Agent, or Firm*—Quarles & Brady

[57] ABSTRACT

An accessory rail adapted to be attached to an existing spray rail of a boat bottom is disclosed. The accessory rail includes a mounting portion having a first supporting surface adapted to abut a substantially vertical surface of the existing spray rail, and a rail portion extending downward from the mounting portion and including a water deflecting surface. The rail portion includes a second supporting surface adapted to abut a substantially horizontal surface of the existing spray rail. The water deflecting surface may be a flat or a curved surface.

8 Claims, 1 Drawing Sheet

Fig. 1
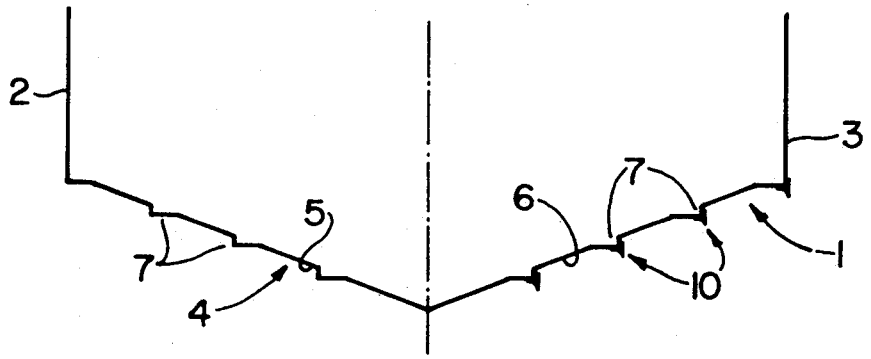
Fig. 2
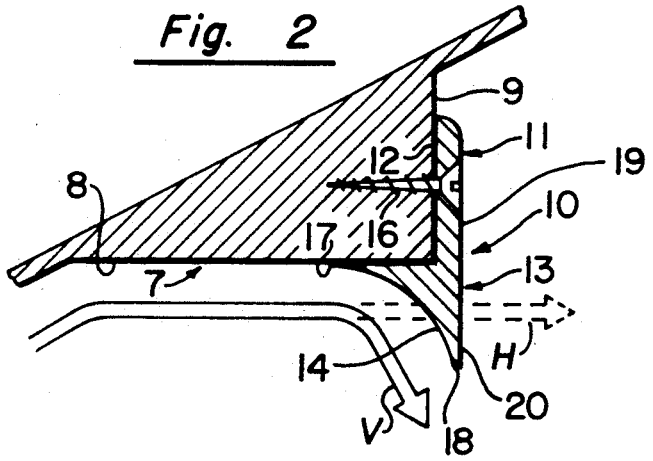
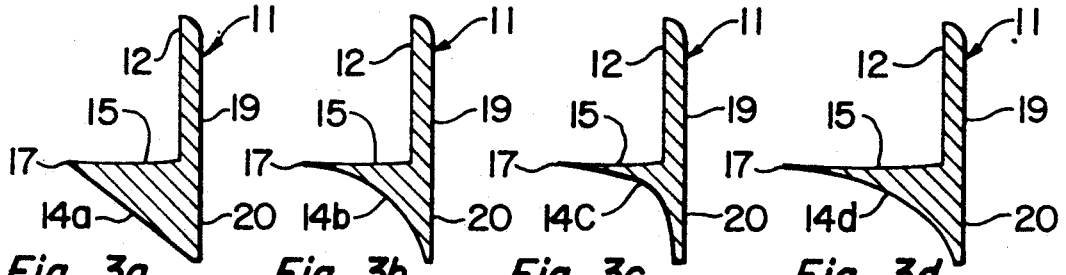
Fig 3a Fig. 3b Fig. 3c Fig. 3d
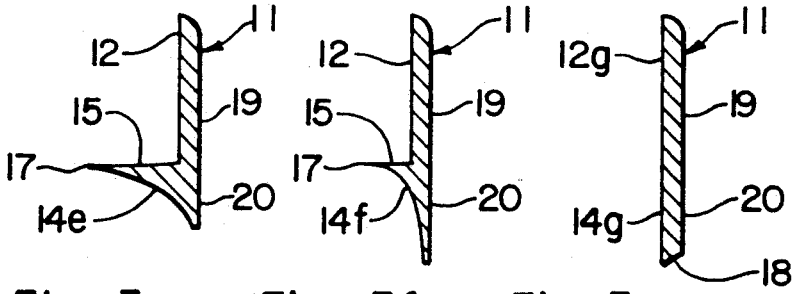
Fig. 3e Fig. 3f Fig. 3g

ACCESSORY RAIL FOR BOATS

BACKGROUND OF THE INVENTION

The present invention concerns an accessory rail for boats, i.e., a rail adapted to be mounted on existing longitudinally extending raisers o spray rails at the bottom of a boat in order to improve the performance of the boat.

U.S. Pat. No. 3,361,104 discloses one kind of accessory rail adapted to be attached to a smooth boat bottom in order to improve the stability of the boat and to cushion the boat against slamming down on the water when cruising in rough sea.

SUMMARY OF THE INVENTION

Contrary to the patent mentioned the object of the present invention is to improve the performance of a boat already provided with conventional spray rails.

A particular object of the present invention is to provide an accessory rail suitable for attachment to existing spray rails of the kind including a substantially horizontal surface and a substantially vertical surface, both extending in the longitudinal direction of a boat bottom.

According to the present invention, an accessory rail adapted to be attached to an existing spray rail includes a mounting portion having a first supporting surface adapted to abut a substantially vertical surface of the existing spray rail, and a rail portion extending downwards from the mounting portion and including a water deflecting surface.

In certain embodiments of the present invention the rail portion includes a second supporting surface adapted to abut a substantially horizontal surface of the existing spray rail.

The mounting portion may be provided with means for its attachment to an existing spray rail such as through holes for screws.

BRIEF DESCRIPTION OF THE DRAWINGS

The invention will now described more in detail reference being made to the accompanying drawings, wherein:

FIG. 1 is a schematic section through a boat hull the bottom of which is equipped with conventional spray rails, the spray rails on the starboard half of the bottom being provided with accessory rails according to the present invention;

FIG. 2 is a section through a portion of the boat bottom of FIG. 1 showing at an enlarged scale a conventional spray rail and a rail according to the present invention mounted thereto; and FIGS. 3*a–g* are sections through various embodiments of the accessory rail according to the present invention.

DETAILED DESCRIPTION OF THE INVENTION

The hull shown in FIG. 1 is a conventional V-bottom hull 1 having a port side 2, a starboard side 3 and a bottom 4 including a port bottom half 5 and a starboard bottom half 6. Both bottom halves are shown being provided with three mutually parallel spray rails 7 extending in the longitudinal direction of the hull.

As is shown more clearly in FIG. 2 each spray rail 7 comprises a substantially horizontal surface 8 and a substantially vertical surface 9. Spray rails of this conventional kind serve as a means to bring a boat faster to a planing position and to stabilize the boat at planing speeds, the substantially horizontal surface lifting the boat and the substantially vertical surface preventing unintended lateral movement. The substantially horizontal surface directs the water flowing along the bottom in a mainly horizontal lateral direction away from the hull, as shown with a dashed arrow H in FIG. 2.

In order to provide more lifting force the present invention aims at directing such laterally flowing water in a downward direction and provides an accessory rail 10 having a mounting portion 11 including a supporting surface 12, and a rail portion 13 including a water deflecting surface 14 and a supporting surface 15. The supporting surfaces 12 and 15 are adapted to closely abut the substantially vertical surface 9 and the substantially horizontal surface 8, respectively, of the spray rail 7. By means of a plurality of longitudinally distributed screws, one screw 16 being shown in FIG. 2, extending through the mounting portion 11 and the substantially vertical surface 9 of the spray rail 7 into the bottom of the boat, the rail 10 is firmly attached to the existing spray rail 7. In this position, the water deflecting surface 14 merging with the supporting surface 12 in a relatively sharp tip 17, constitutes a concavely curved continuation of the substantially horizontal surface 8 of the spray rail 7 deflecting water flowing laterally along surface 8 in a downward vertical direction as shown by arrow V in FIG. 2. The degree of downward direction is, of course, dependent of the shape of the water deflecting surface 14, and, particularly, on the direction of the tangent thereto at the downwardly directed apex 18 of the rail portion 13.

Various shapes of the water deflecting surface 14 are shown in FIGS. 3*a–g*.

In the embodiment of FIG. 3*a* the water deflecting surface 14*a* is a plane surface defining an angle with the supporting surface 15 and deflecting the water approximately 40° downwards from its original flowing direction.

In FIG. 3*b* the water deflecting surface 14*b* is a concave curved surface having a relatively great radius and deflecting the water an angle of approximately 60°.

In the embodiment of FIG. 3*c* the water deflecting surface 14*c* is a conave curved surface having a relatively small radius and deflecting the water approximately 90°.

In the rail of FIG. 3*d* the water deflecting surface 14*d* has a relatively wide supporting surface 15 and an approximately part-elliptical concavely curved section deflecting the water approximately 50°.

Also in the embodiment of FIG. 3*e* the water deflecting surface 14*e* is approximately part-elliptical but terminates at a shorter distance from the substantially horizontal surface 8 of the spray rail 7 than in the embodiment of FIG. 3*d*. The water deflecting surface 14*e* deflects the water approximately 70°.

In the embodiment of FIG. 3*f* the supporting surface 15 has a relatively small width and the water deflecting surface 14*f* is approximately part-elliptical deflecting the water approximately 90°.

The simplest embodiment of the invention is shown in FIG. 3*g* and comprises a flat piece, the supporting surface 12*g* of which is aligned with the water deflecting surface 14*g* thereof. Since the accessory rail of this embodiment includes no horizontal supporting surface 15 as do the embodiments of FIGS. 3*a–f* it may be mounted such that its downward directed apex 18 is located at variable vertical distances under the boat bottom, thereby enabling adjustment of the rail in order to obtain an optimum mounting position. In order to facilitate such variable mounting the rail according to this embodiment may be provided with substantially vertically extended oblong mounting holes (not shown) for screws 16.

It is common for all the embodiments shown that the surface 19 of the mounting portion 11 opposed to the supporting surface 12 thereof is substantially parallel to the supporting surface 12 and is flush with a surface 20 of the rail portion 13 opposed to the water deflecting surface 14 thereof.

It should be appreciated that other means than screws can be employed for attaching the rail 7 to an existing spray rail, such as glueing. Further, a wide variety of shapes of the water deflecting surface 14 may be useful, and also different relative dimensions between the width of the supporting surface 15 and the height of the rail portion 13 counted from the substantially horizontal surface 8 of the spray rail 7.

I claim:

1. A rail adapted to be attached to an existing spray rail of a boat bottom, said existing spray rail including a substantially vertical surface portion and a substantially horizontal surface portion, said rail comprising:

a mounting portion having a first supporting surface adapted to abut said substantially vertical surface portion of said existing spray rail;

a rail portion extending downwards from said mounting portion and including:

a second supporting surface adapted to abut said substantially horizontal surface portion of said existing spray rail; and a water deflecting surface;

wherein said rail portion extends downwardly to a level below said second supporting surface, said second supporting surface extends from said first supporting surface so as to terminate at a distance therefrom, and said water deflecting surface extends from said level so as to merge with said second supporting surface at said distance from said first supporting surface.

2. A rail according to claim 1, wherein said water deflecting surface merges into a tip with said second supporting surface.

3. A rail according to claim 2, wherein the mounting portion (11) is provided with through-holes for mounting screws (16).

4. A rail according to claim 1, wherein said mounting portion is provided with through holes for mounting screws.

5. A rail according to claim 1, wherein the water deflecting surface is a flat surface defining an angle with the second supporting surface.

6. A rail according to claim 5, wherein the mounting portion (11) is provided with through-holes for mounting screws (16).

7. A rail according to claim 1, wherein the water deflecting surface is a curved surface.

8. A rail according to claim 7, wherein the mounting portion (11) is provided with through-holes for mounting screws (16).

* * * * *